US005142804A

United States Patent [19]

Hillstrom et al.

[11] Patent Number: 5,142,804

[45] Date of Patent: Sep. 1, 1992

[54] RELEASABLE ANCHORING AND TENSIONING APPARATUS FOR BILLBOARD DISPLAYS

[75] Inventors: David U. Hillstrom, Novi; Nicholas A. DeRosa, Canton, both of Mich.

[73] Assignee: Marketing Displays, Inc., Farmington Hills, Mich.

[21] Appl. No.: 719,794

[22] Filed: Jun. 24, 1991

Related U.S. Application Data

[63] Continuation of Ser. No. 320,775, Mar. 8, 1989, abandoned, which is a continuation-in-part of Ser. No. 187,587, Apr. 28, 1988, Pat. No. 4,862,614.

[51] Int. Cl.[5] ..... G09F 17/00

[52] U.S. Cl. ..... 40/603; 40/624

[58] Field of Search ..... 24/68 FP, 68 R; 74/106, 74/520; 40/603, 624; 38/102.1, 102.91; 160/378, 328, 329

[56] References Cited

U.S. PATENT DOCUMENTS

| | | | |
|---|---|---|---|
| 2,127,060 | 8/1938 | Hansen et al. | 160/328 X |
| 4,542,605 | 9/1985 | Gandy | 40/603 X |
| 4,554,754 | 11/1985 | Stilling | 40/603 |
| 4,580,361 | 4/1986 | Hillstrom et al. | 40/603 |
| 4,674,214 | 6/1987 | Gandy | 40/603 |
| 4,862,615 | 9/1989 | Hillstrom | 40/603 |
| 4,894,960 | 1/1990 | Hill et al. | 40/603 X |

*Primary Examiner*—James R. Brittain

*Attorney, Agent, or Firm*—Brooks & Kushman

[57] ABSTRACT

An anchoring apparatus for anchoring and tensioning a sheet material on a panel structure, such as a billboard. A preferred channel-shaped base member is secured to the rear of the panel structure and includes a clip member slidably interconnected with the base member. The clip member is selectively biased to tension the sheet material, or disengaged to release or relax the sheet material, preferably by way of a spring member, and by way of actuation of a preferred built-in anchoring handle mechanism, thus greatly facilitating the ease and speed of erection, anchoring, tensioning and removal of the sheet material.

21 Claims, 7 Drawing Sheets

RELEASABLE ANCHORING AND TENSIONING APPARATUS FOR BILLBOARD DISPLAYS

This is a continuation of application Ser. No. 320,775, filed on Mar. 8, 1989, now abandoned, which in turn was a continuation-in-part of application Ser. No. 187,587, filed on Apr. 28, 1988, now U.S. Pat. No. 4,862,615 which issued on Sept. 5, 1989.

BACKGROUND AND SUMMARY OF THE INVENTION

The invention relates generally to an apparatus for anchoring and selectively tensioning or relaxing a sheet material on a panel structure, and more particularly to such apparatuses used for anchoring and selectively tensioning and relaxing or releasing a sheet material display on a billboard structure.

Large billboards displaying advertising or public service messages are a common sight along roadways and other areas for communicating messages to the public. One common type of billboard has a front display face that is fourteen feet high and forty-eight feet wide. Although other sizes of billboards are also used, this fourteen foot by forty-eight foot size is especially advantageous for high visibility along roadways and from relatively great distances.

Although effective for communicating advertising or public service messages, the processes of positioning a display message on such billboards, and of replacing one display message with another, have been found to be expensive, time-consuming, and cumbersome. In the past, such display messages were painted or printed on a paper-like sheet of material, which was then cut into strips or sections that could be pasted or otherwise adhered to the front face of the billboard. More recently, large relatively flexible sheets of synthetic materials were developed, typically composed of a reinforced nylon material, onto which the display message was painted or otherwise printed, typically with the use of computer-aided processes. These large synthetic sheet material displays, commonly referred to as "superflex" material, are then rolled onto a large roll, which was then lifted into position using a crane or other suitable lifting apparatuses. The sheet material display is then unrolled onto the front face of the billboard, with the vertical and horizontal edge portions of the sheet material display extending around the edges of the billboard. The edges are then typically anchored and tensioned by way of a number of separate of flexible strip-and-hook mechanisms, which include a wheel-type ratchet mechanism for tightening the strap and thereby tensioning the sheet material display.

The above-described method and apparatus for anchoring and tensioning the sheet material display on the billboard, using the strap and ratchet wheel mechanisms described above, have been found to present a number of significant disadvantages. First, the personnel involved in anchoring and tensioning the display sheet are required to carry a large number of the strap and ratchet wheel mechanisms when climbing onto the rear face of the billboard, frequently at great heights. Secondly, because of variations in the supporting structure for the billboard, there are frequently no conveniently-located portions of the support structure to which the straps can be anchored.

Accordingly, in the case of the large billboards mentioned above, the erection, anchoring, and tensioning of sheet material billboard display frequently takes several hours to accomplish and presents great danger and difficulty to persons performing the task. Also, because one end of the strap and ratchet wheel mechanisms includes a hook that must be inserted through an opening in a bar that is in turn hemmed into the edges of the sheet material, anchoring difficulties are frequently encountered if the holes in the anchoring bar are not located near a support member of the billboard supporting structure. As a result, in such an instance, the opposite end of the strap and ratchet wheel mechanisms must be secured to the supporting structure by way of ropes, cables, wire, additional straps, or the like, which is cumbersome, time-consuming and frequently unsuitable.

In addition to the above disadvantages, the prior anchoring and tensioning devices were frequently inadequate in accommodating expansion and contraction of the billboard sheet material display and maintaining a tight, neat-appearing fit. This is especially important in areas that experience wide temperature variations or in applications where the billboard experiences wide variations in the incident sun exposure.

Accordingly, the need has arisen for a simpler, more uniform, and more convenient apparatus for anchoring, tensioning, and subsequently releasing a sheet material display on a billboard structure. The present invention seeks to meet this need by providing an apparatus that is associated and attached to the billboard and that allows for easily and conveniently tensioning and subsequently relaxing a sheet material display on a billboard structure. In some embodiments of the invention, the apparatus also maintains a proper tensioning force that accommodates expansion and contraction of the sheet material display and thus substantially prevents sagging and wrinkles.

The apparatus according to the present invention includes an elongated base member having a generally U-shaped lateral cross-section, with the base member including a base plate portion and a pair of laterally spaced-apart leg portions protruding from the base plate portion. Each of the leg portions preferably includes a slot formed therein, with the slots on the leg portions facing and opening generally toward one another. In some of the preferred embodiments, the base portion further includes a number of ratchet teeth serially spaced longitudinally therealong, and openings are formed in the base portion for receiving fasteners in order to fixedly secure the elongated base member to the panel or billboard structure. Alternatively, other known devices can be included for fixedly securing the base member to the panel structure.

The anchoring and tensioning apparatus of the invention also includes a clip member having a clip plate portion received within the above-mentioned slots for selective slidable longitudinal movement along the base member, an attachment portion for releasably engaging a portion of the sheet material or an anchoring bar hemmed into the sheet material, and in some embodiments, a pawl portion protrudes from the clip plate portion and is resiliently biased into releasable ratcheting engagement with the ratchet teeth on the base member. Such engagement with any one of the ratchet teeth substantially prevents longitudinal movement of the clip member relative to the base member in a longitudinal direction toward the edge of the billboard when the pawl portion engages one of the ratchet teeth, thus anchoring the sheet material display in a desired, tensioned state. The clip member is selectively movable in an opposite longitudinal direction away from the edge of the billboard relative to the base member in order to serially advance the pawl portion from engagement with one of the ratchet teeth to engagement with an adjacent ratchet tooth, thereby increasing the tensioning of the sheet material. The pawl portion is also selectively releasable in order to disengage from the ratchet teeth in order to then allow movement of the clip member relative to the base member toward the edge of the billboard, thereby relaxing or releasing the sheet material for removal.

In the above-mentioned ratchet version of the invention, the tensioning of the sheet material is accomplished by inserting a screwdriver or other lever-type member through an opening formed in the clip plate portion and into engagement with the ratchet teeth in order to forcibly pry or urge the clip member with a pivoting motion of the lever so as to move the clip member relative to the base member and away from the edge of the billboard. Releasing or relaxation of the sheet material display is preferably accomplished by inserting the screwdriver or other lever member through an opening in the clip plate portion and into engagement with a discontinuity on the pawl portion of the clip member, thus allowing the resilient pawl portion to be forcibly disengaged from the ratchet teeth and allowing the clip member to be moved relative to the base member in longitudinal direction toward the edge of the billboard, thereby relaxing or releasing the tension on the sheet material display.

Furthermore, in the preferred embodiments of the present invention, the attachment portion of the clip member includes a generally hook-shaped end adapted for releasable engagement with the sheet material or with an anchoring member or bar secured to the sheet material. Preferably, the anchoring bar or member includes a groove formed therein for releasably and interlockingly receiving the hook-shaped end of the attachment portion of the clip member. The preferred attachment portion of the clip member is at least partially offset outwardly or rearwardly away from the base member in an area adjacent the hook-shaped end, thus allowing the anchoring bar or member on the sheet material to be disposed between the offset portion and the base member when the hook-shaped end is received within the groove in the anchoring bar or member. This provides clearance for tensioning or relaxing movement of the anchored edge of the sheet material relative to the base member of the apparatus, as well as allowing for convenient engagement or disengagement of the attachment portion with or from the sheet material.

In preferred embodiments of the invention, the clip member is resiliently biased in a longitudinal direction away from the edge of the billboard or other panel structure in order to exert a positive, but resiliently variable, tensioning force on the sheet material. Such resilient biasing feature can be employed in conjunction with the above-described ratcheting feature, or alternately with an anchoring handle or lever member that is pivotally, or otherwise movably attached to, or interconnected with, the anchoring apparatus in order to selectively tighten the sheet material or to release the sheet material by applying a force against the above-mentioned resilient biasing component. In some versions of these preferred embodiments, the anchoring handle or lever is also pivotal, or otherwise movable, in either its tightening or its releasing position, in order to be operated or stored without interference with other billboard components or appurtenant members or devices. Preferably the position and/or the range of longitudinal tensioning of the anchoring and tensioning apparatus is pre-adjustable in order to provide for a wide degree of flexibility in sheet material installation. The anchoring handle or lever member, and/or the clip portion of the clip member, can optionally be elongated, angled, or otherwise configured to minimize interference with other components or members, or to allow for more convenient access by the personnel installing the sheet material on the billboard or other panel structure.

Additional objects, advantages and features of the present invention will become apparent from the following description and appended claims, taken in conjunction with the accompanying drawings.

DETAILED DESCRIPTION OF THE PREFERRED EMBODIMENTS

FIGS. 1 through 17 depict various preferred, exemplary embodiments of an anchoring apparatus according to the present invention, which are particularly adapted for anchoring and tensioning a sheet material display on a large billboard structure. One skilled in the art will readily recognize from the following description that the present invention is not limited to billboard applications, but is also advantageous in other structures wherein a sheet material is to be anchored and selectively tensioned or relaxed on a panel or other structure.

Figure 1:
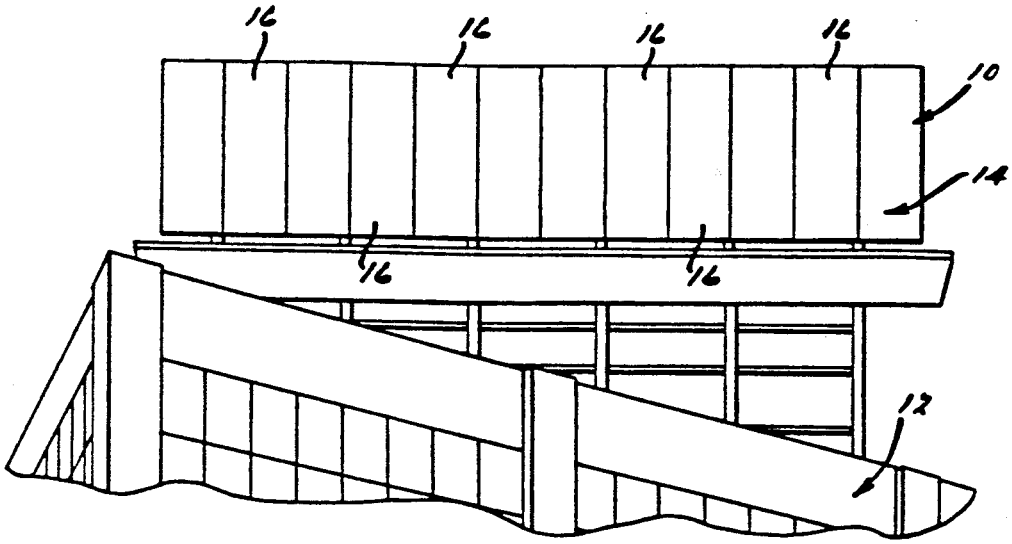
FIG. 1 illustrates a typical billboard installation, exemplifying one of the primary applications of the present invention.
Figure 2:
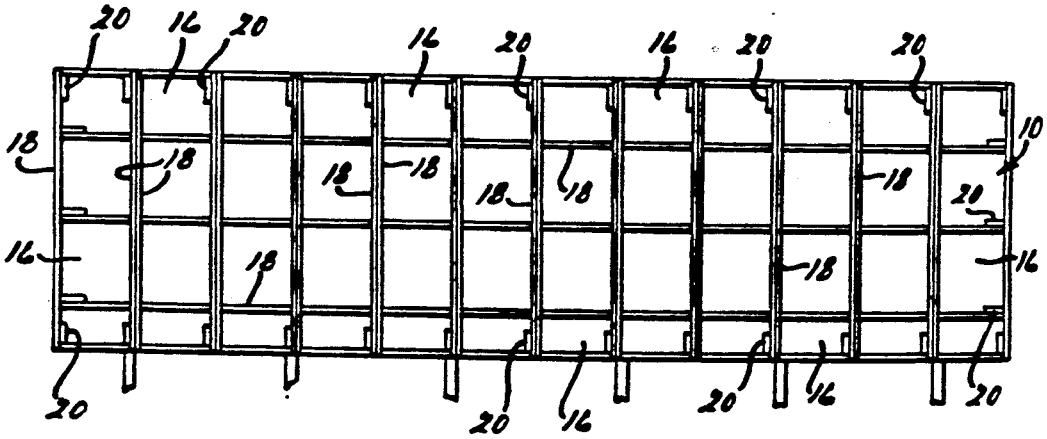
FIG. 2 is a somewhat diagrammatic elevational view of the rear face of the billboard of FIG. 1, generally illustrating the installation of a number of anchoring and tensioning apparatuses according to the present invention for anchoring and selectively tensioning or relaxing a sheet material display on the billboard.

FIGS. 1 and 2 depict a large exemplary billboard structure 10, which can be mounted on the roof of a building 12 or supported from the ground in many typical installations. In a common construction of such a billboard structure 10, a relatively flexible sheet material display 14, bearing an advertising or public service message, is disposed on a front face of the billboard structure 10, with edge portions of the sheet material display extending around the edge of the billboard structure and along a portion of the rear face of the billboard structure 10.

Figure 3:
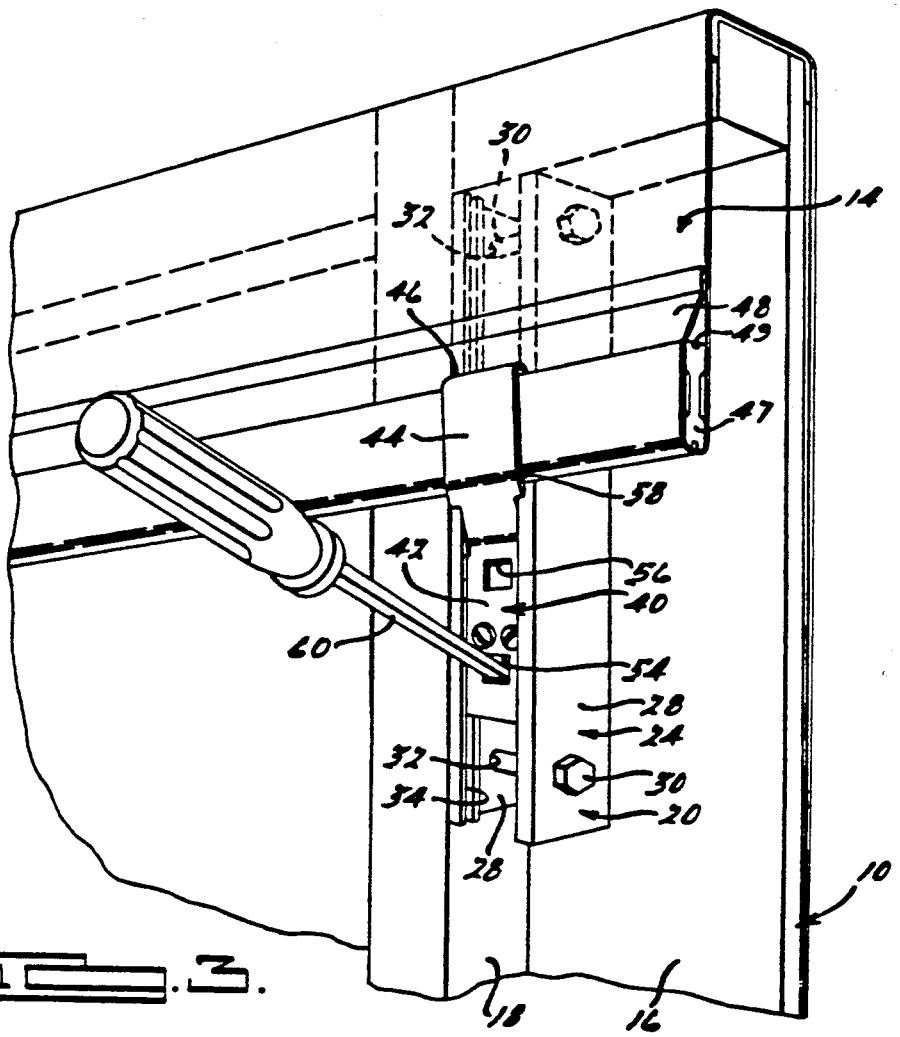
FIG. 3 is an enlarged, perspective detail view of one of the anchoring and tensioning apparatuses according to the present invention installed on a typical billboard structure.
Figure 6:
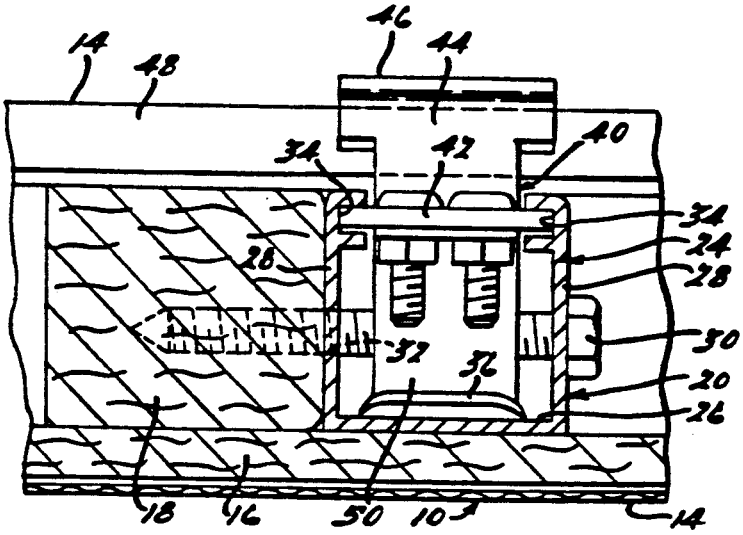
FIG. 6 is a cross-sectional view taken generally along line 6—6 of FIG. 4.
Figure 4:
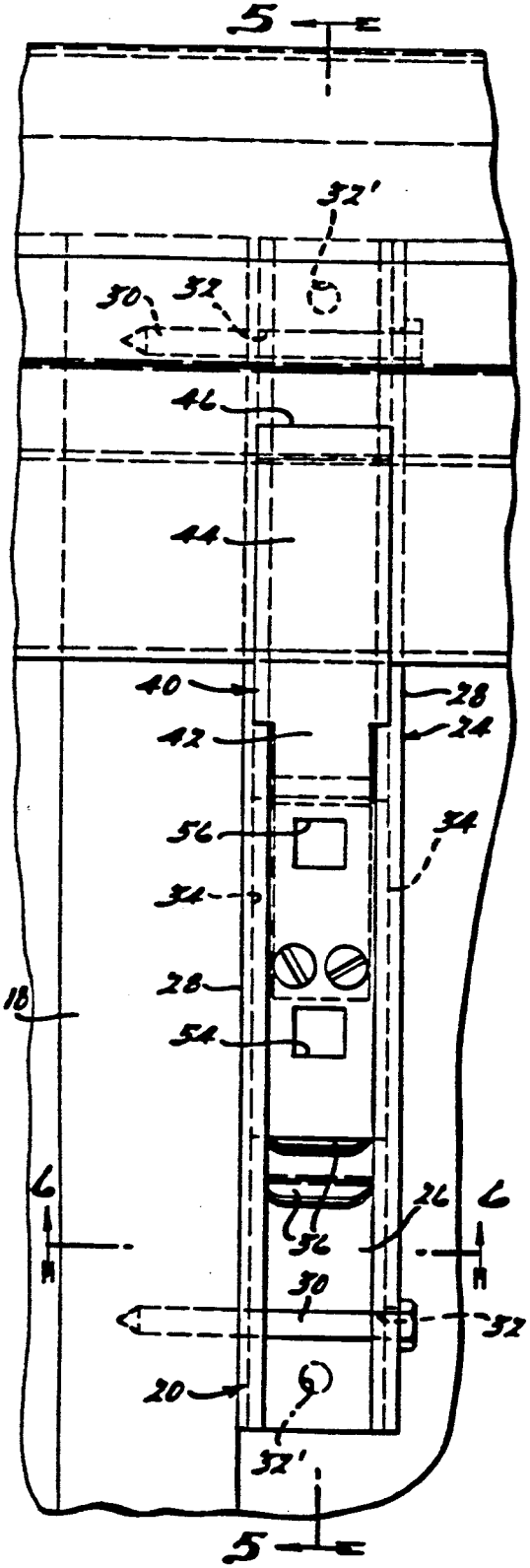
FIG. 4 is an elevational view of the anchoring apparatus of FIG. 3.

As illustrated in FIGS. 2 and 3, the billboard structure 10 typically includes a number of panel portions 16, with their associated panel frames 18. In the common fourteen-foot by forty-eight foot size billboard mentioned above, such a construction would result in twelve four-foot by fourteen-foot panel portions being secured together by fastening or securing means, such as lag screws, tie rods, or other securing methods known to those skilled in the art. As shown diagrammatically in FIG. 2, a number of anchoring apparatuses 20, according to one embodiment of the present invention, are secured to the panel frames 18 of the panel portion 16 and grippingly engage the sheet material display 14, as is shown in more detail in FIG. 3.

Each of the anchoring and tensioning apparatuses 20 for the exemplary billboard application illustrated in the drawings includes a base member 24, which has a generally U-shaped lateral cross-section, including a base plate portion 26 and a pair of laterally spaced-apart leg portions 28 protruding rearwardly or outwardly from the base plate portion 26, as shown in FIGS. 3 through 6. One or more fasteners 30 extend through openings 32 in the leg portions 28 in order to fixedly secure the base member 24 to the panel frames 18 of the panel portions 16. Optionally, however, if necessary or desired in a particular application of any of the embodiments of the invention, openings 32' can be provided in the base plate portion 26 in addition to, or in lieu of, the openings 32 extending through the leg portions 28.

Each of the leg portions 28 preferably includes a slot 34 extending longitudinally therethrough, with the slots 34 preferably facing generally toward one another and disposed generally at outer edges of the leg portions 28 or otherwise spaced outwardly away from the base plate portion 26. A plurality of ratchet teeth 36 are preferably included in the base plate portion 26 in the embodiment illustrated in FIGS. 2 through 6, although in certain applications of the present invention, such ratchet teeth 36 could alternately be provided at positions other than on the base plate portion 26, as will become apparent to one skilled in the art.

A clip member 40 includes a clip plate portion 42, whose lateral edges are preferably slidably received within the slots 34 in the leg portions 28 for selective slidable longitudinal movement relative to the base member 24. The clip member 40 also includes an attachment portion 44, which can be formed integrally with the clip plate portion 42, as illustrated in the drawings, or which can alternately be a separate piece secured to the clip plate portion by fasteners, such as screws, rivets, or other means suitable for the given application. The attachment portion 44 preferably includes a generally hook-shaped end 46, which is adapted to grippingly and anchoringly engage a preferred anchor member or bar 47 secured to the sheet material display 14, such as the anchoring member 47 shown in the drawings, which is received within a hem portion 48. The preferred anchoring member 47 includes a groove 49 formed in one or more of its edges for receiving the hook-shaped end 46 of the attachment portion 44 in a generally interlocking, but releasable relationship, shown in FIGS. 3 and 5.

The clip member 40, which is preferably composed of spring steel, also includes a pawl portion 50, which likewise may be integrally formed therewith, or attached thereto as shown in the drawings, with the pawl portion 50 preferably being resiliently biased into engagement with the ratchet teeth 36, such that when the pawl portion 50 is in such engagement with any one of the ratchet teeth 36, the clip member 40, and thus the sheet material display 14 are substantially prevented from longitudinal movement in a direction toward the edge of the billboard structure 10, as shown in FIG. 3. In order to securely retain the sheet material display 14 in its desired position on the billboard structure 10, with a desired amount of tension in order to substantially eliminate or minimize sagging or wrinkles in the sheet material display, the clip member 40 is urged or biased in a tensioning direction, generally away from the edge of the billboard structure 10 shown in FIG. 3, with the pawl portion 50 resiliently engaging one of the ratchet teeth 36.

Figure 5:
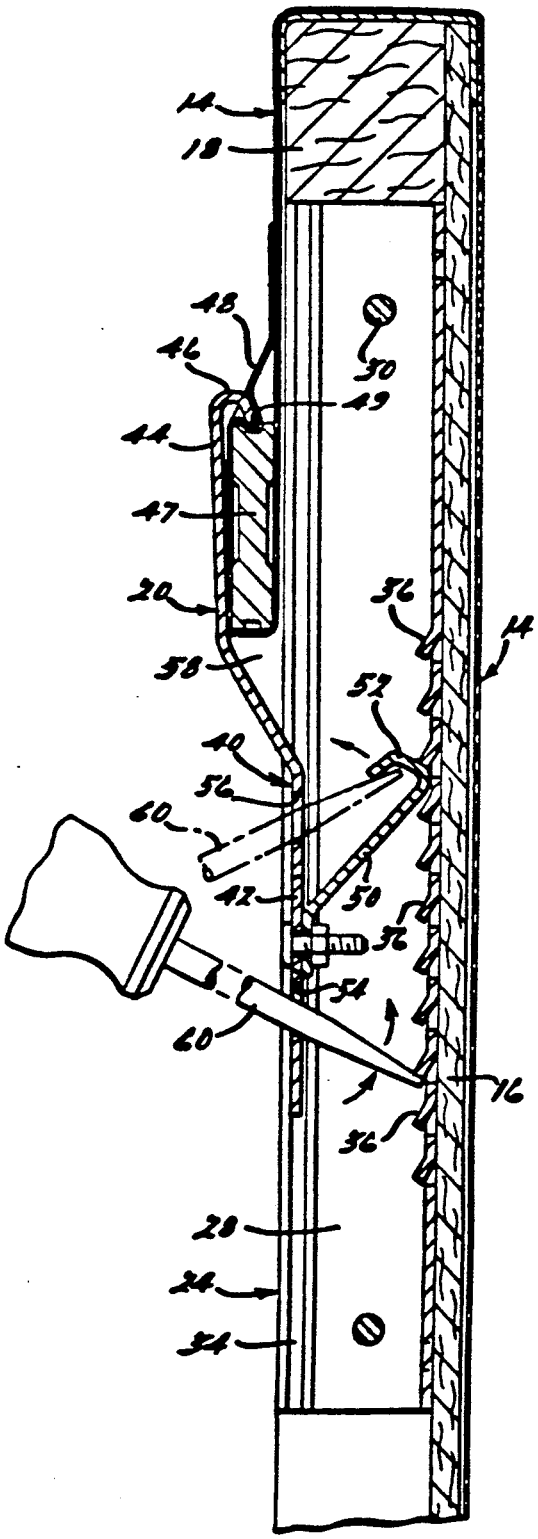
FIG. 5 is a cross-sectional view taken generally along line 5—5 of FIG. 4.

In order to increase the tension on the sheet material display 14, a tensioning opening 54 is provided in the clip plate portion 42 for allowing the insertion of a screwdriver or other lever member 60 therethrough into engagement with one of the ratchet teeth 36. After which, the lever member 60 can be manipulated in a generally prying or pivoting manner in order to forcibly urge the clip plate portion, and thus the edge of the sheet material display 14, in a tensioning direction away from the edge of the billboard structure 10, as shown in FIGS. 3 and 5. Because the preferred anchoring apparatus 20 is secured to, and thus permanently associated with, each of the panel portions 16 in the exemplary application shown in the drawings, such anchoring and selective tensioning of the sheet material display 14 is accomplished with relative ease and convenience, using only a common tool, such as a screwdriver, as a lever member 60. In addition, no separate straps or ratchet wheels need be provided at a billboard site or carried up onto a billboard structure.

When it is desired to remove or replace a particular sheet material display 14, in order to eliminate or change the message displayed on the billboard structure 10, a screwdriver or other lever member 60 can then be inserted through a release or relaxation opening 56 in the clip plate portion 42, into engagement with a hook or discontinuity 52 in the pawl portion 50 in order to allow the resiliently-biased pawl portion 50 to be pried or pivoted out of engagement with the ratchet teeth 36. This allows the clip plate portion, and thus the attachment portion 44, the anchoring member 47, and the edge of the sheet material display 14, to be moved in a second longitudinal direction, generally toward the edge of the billboard structure 10, as shown in the detailed perspective view of FIG. 3. Such a maneuver releases the tension on the sheet material display 14, thereby allowing the anchoring member 47 to then be moved slightly in a downward direction (as viewed in FIG. 3) to disengage the hook-shaped end 46 of the attachment portion 44 from the groove 49 in the anchoring member 47. The anchoring member 47 can be rotated slightly out of the space 58 between the offset and preferably resilient attachment portion 44 and the base member 24, thereby releasing the edge of the sheet material display 14 from the anchoring apparatus 20, and consequently allowing removal or replacement of the sheet material display 14.

After the display sheet 14 has been removed, the anchoring apparatuses 20 remain secured to the panel frame members 18 and can be left with their clip members 40 in a relaxed or "loosened" positions generally aligned with one another to allow for ease of insertion of, and engagement with, the anchoring member 47 on the display sheet 14 of a new display. This aids greatly in the erection, anchoring and tensioning of the replacement display.

Figure 7:
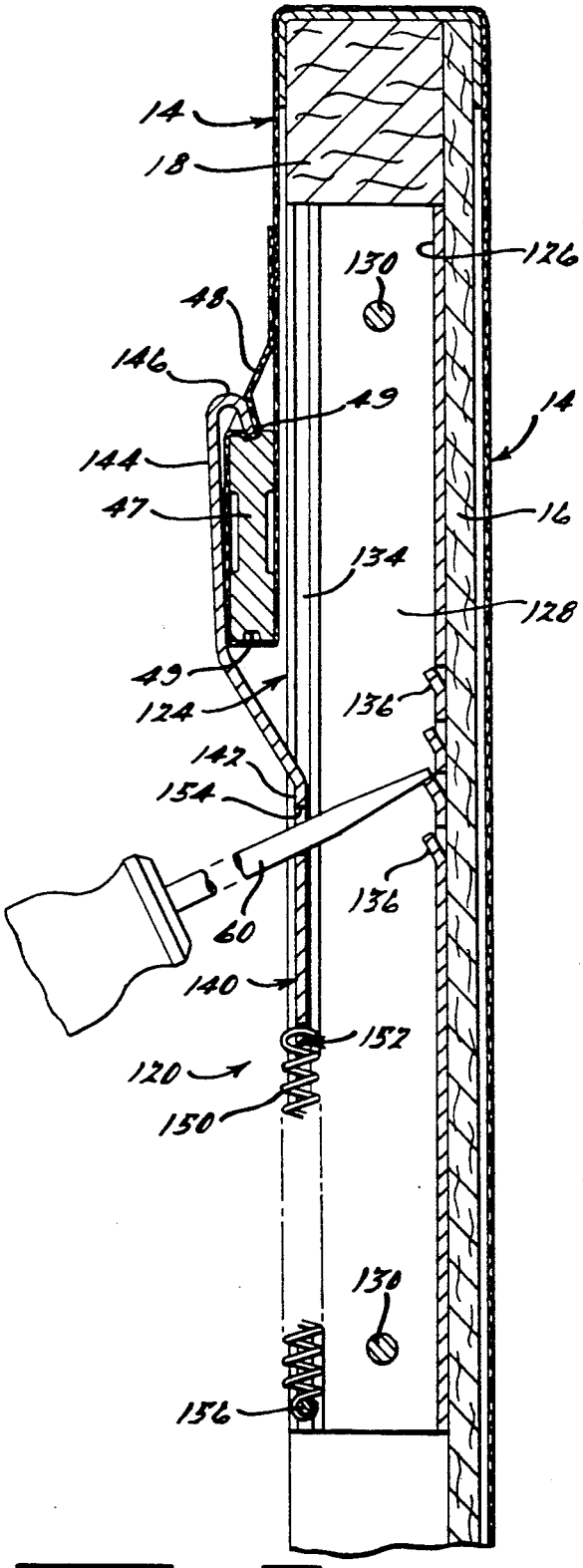
FIG. 7 is a cross-sectional view similar to that of FIG. 5, but illustrating another embodiment of the invention wherein the anchoring and tensioning apparatus includes a ratcheting feature similar to that of FIGS. 3 through 6, as well as a resilient biasing feature for maintaining the proper tension on the sheet material display.

In FIG. 7, an alternate embodiment of the present invention is disclosed, wherein the anchoring and tensioning apparatus 120 is substantially similar to the anchoring and tensioning apparatus 20 described above, with certain exceptions noted below. Because of the similarity of many components of the apparatus 20 and the apparatus 120, components that are similar or that perform a corresponding function are indicated by reference numerals in FIG. 7 that are the same as those of FIGS. 3 through 6, but which are one hundred numerals higher.

In FIG. 7, the ratchet and pawl arrangement of the apparatus 20 is replaced by a clip member biasing arrangement including a spring member 150 for resiliently biasing the clip member 40, and thus the sheet material display 14 in a tensioning longitudinal direction. In order to allow the sheet material display 14 to be released or relaxed, thus allowing the hook-shaped end 146 of the clip member 140 to be disengaged from the sheet material display 14 and the anchoring member or bar 47, an opening 154 is provided in the clip member 140 for allowing a lever member 60 to be inserted therethrough for engagement with any of a number of ratchet teeth 136 formed in the base plate portion 126. This arrangement allows for movement of the lever member 60 in a direction to urge the clip member 140 in a longitudinal direction against the resilient biasing force of the spring member 150, thereby relaxing of the sheet material display and allowing the disengagement from the hook-shaped end 146. In other respects, however, the function of the anchoring and tensioning apparatus 120 is generally similar to that described above in connection with the anchoring and tensioning apparatus 20.

Figure 8:
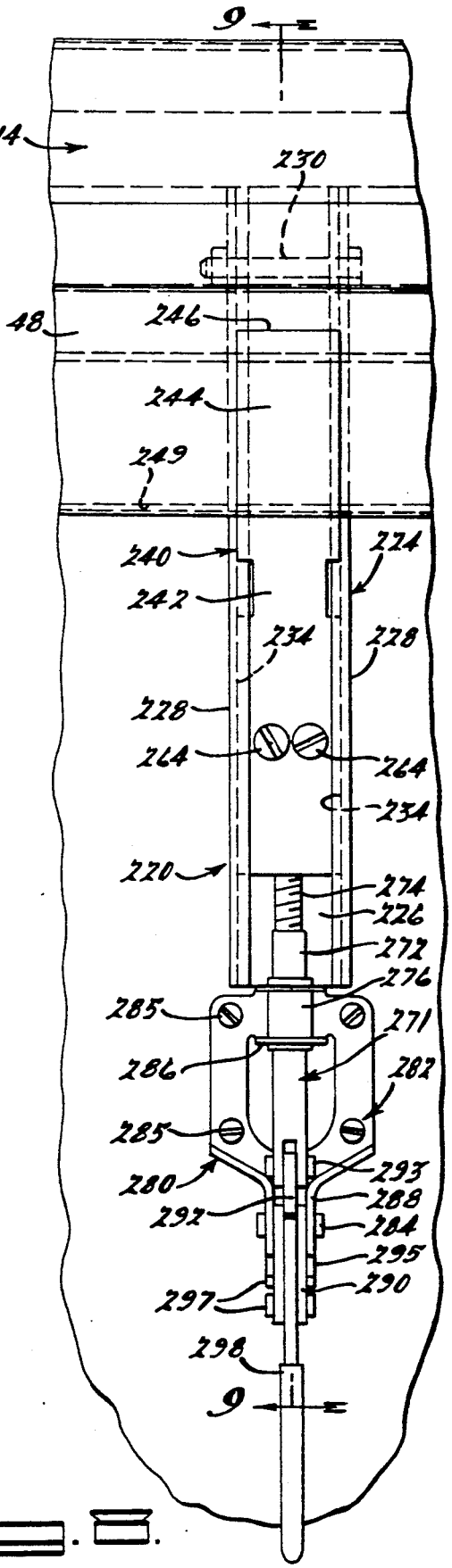
FIG. 8 is an elevational view of still another preferred embodiment of the anchoring and tensioning apparatus of the present invention, including the above-mentioned resilient biasing feature and a built-in anchoring handle selectively movable between a tightening or tensioning position and a release position.
Figure 9:
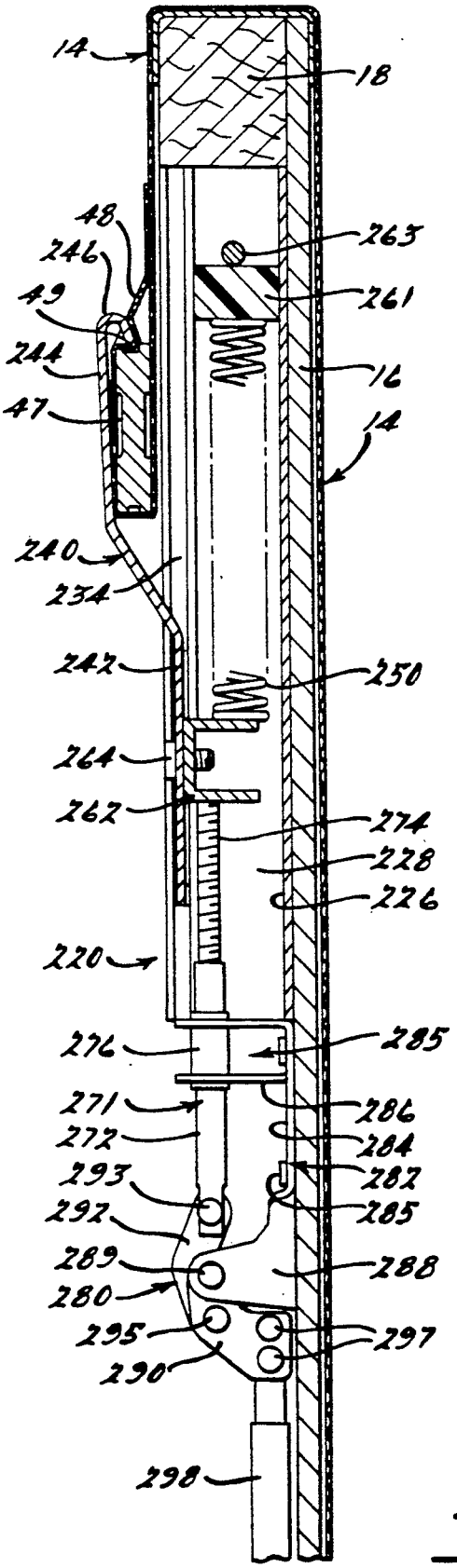
FIG. 9 is a cross-sectional view taken generally along line 9—9 of FIG. 8.

FIGS. 8 and 9 illustrate one of the preferred embodiments of the invention, wherein an anchoring and tensioning apparatus 220 is generally similar in some respects to the anchoring and tensioning apparatuses 20 and 120, and therefore similar or corresponding components are indicated by reference numerals similar to those used in FIGS. 3 through 7, but having a two-hundred prefix.

The anchoring and tensioning apparatus 220 in FIGS. 8 and 9 includes a preferably built-in handle or lever mechanism indicated generally by reference numeral 280, in lieu of the ratchet and lever member arrangement of the embodiments described above. The apparatus 220 also includes a pair of abutment members 261 and 262, between which the spring member 250 is resiliently compressed. The abutment member 261 is restrained from longitudinal movement toward the edge of the billboard structure either by a pin 263 or by the pin 230 (shown in FIG. 8), either of which is fixedly secured to the base member 224. The abutment member 262 is secured to the clip member 240, by way of a suitable fastener 264 for movement with the clip member 240 relative to the base member 224. The preferably compressed spring member 250, being trapped between the abutment members 261 and 262, resiliently biases the clip member 240 in the longitudinal direction that tensions the sheet material display 14, accommodates expansion or contraction of the sheet material display 14, while still maintaining a relatively tensioned, need-appearing condition.

In order to allow for the selective tensioning or relaxation of the sheet material display 14, the handle or lever mechanism 280 in FIGS. 8 and 9 preferably includes a pivotal handle member 298 that is pivotally movable between a first longitudinal position wherein the spring member 250 is forceably compressed to a degree allowing for the relaxation of the sheet material display 14 and its disengagement from the clip member 240 and a second longitudinal position wherein the spring member 250 is allowed to resiliently bias the clip member 240 in a longitudinal direction tending to tension the sheet material display 14. Such a function is accomplished by way of a handle mounting bracket 282 fixed relative to the base member 224, either by attachment to the billboard structure or by attachment to the base member 224. The handle mounting bracket 282 includes a plate portion 284 fixedly restrained by one or more suitable fasteners 285 and having a pair of protuberances 286 and 288 extending outwardly therefrom.

An adjustment member 271 extends through a sleeve 276 extending through an opening in the protuberance 286. The adjustment member 271 is interconnected for longitudinal slidable movement relative to the protuberance 286 for abuttingly urging the abutment member 262 and thus the clip member 240 in longitudinal directions when the adjustment member 271 is actuated by the handle member 298, as is described in more detail below. The range of movement of the clip member 240, and thus the handle member 298, is selectively adjustable by shortening or lengthening the adjustment member 271 by way of threadable engagement between a generally hollow adjustment sleeve 272 adapted for threadably receiving an externally threaded adjustment rod 274 therein. By such an arrangement, the range of motion of the clip member 240 can be preselectively adjusted to suit a given application and a desired amount of tensioning of the sheet material display 14.

The adjustment member 271 is pivotally interconnected with the handle member 298 by way of pivot links 290 and 292, which are pivotally interconnected by a pivot pin 295. The pivot link 290 is interconnected with the handle member 298 by a pair of pins or fasteners 297, and is also pivotally interconnected with the protuberance 286 by way of a pivot pin 289. In turn, the pivot link 292 is also pivotally interconnected with the adjustment member 271 by way of a pivot pin 293. Thus, pivotal motion of the handle member 298 in a longitudinally upward direction, as oriented in FIG. 9, causes longitudinal movement of the adjustment member 271 in a direction resulting in further compression of the spring member 250, by way of engagement with the abutment member 262, thereby relaxing the sheet material display 14 and allowing for disengagement from the clip member 240. Conversely, pivotal movement of the handle member 298 in a longitudinally downward direction, as viewed in FIG. 9, allows the spring member 250 to be free to resiliently bias the clip member 240 in a direction tending to tension the sheet material display 14.

The arrangement illustrated in FIGS. 8 and 9 is especially advantageous in that the handle or lever mechanism 280, which actuates the anchoring and tensioning apparatus 220, is built-in, thus being always available at the position of installation of the apparatus 220 on the billboard. It should be noted that other similar pivotal mechanisms can also be substituted for the exemplary mechanism 280, which is a commercially available mechanism used to construct an actual prototype of the invention.

Figure 10:
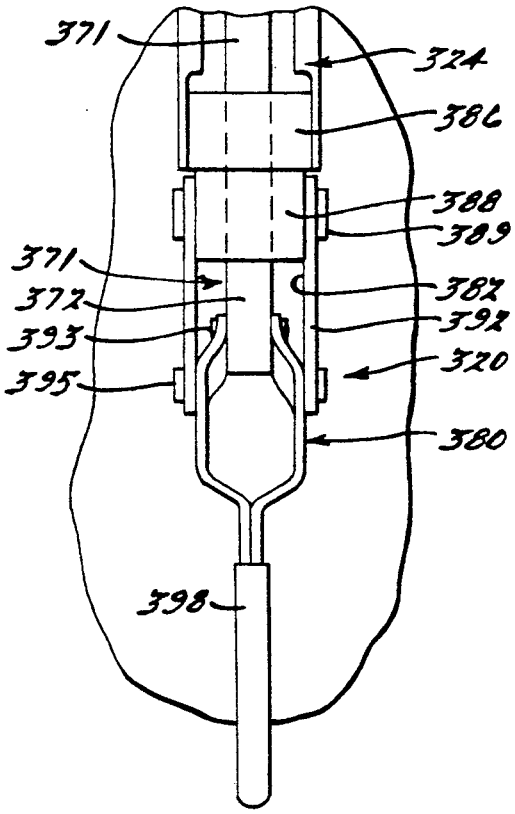
FIG. 10 is an elevational view of the anchoring handle portion (in a tensioning position) of an anchoring and tensioning apparatus similar to that of FIGS. 8 and 9, but wherein the anchoring handle is also laterally pivotal to allow actuation in a variety of pivoted positions.
Figure 11:
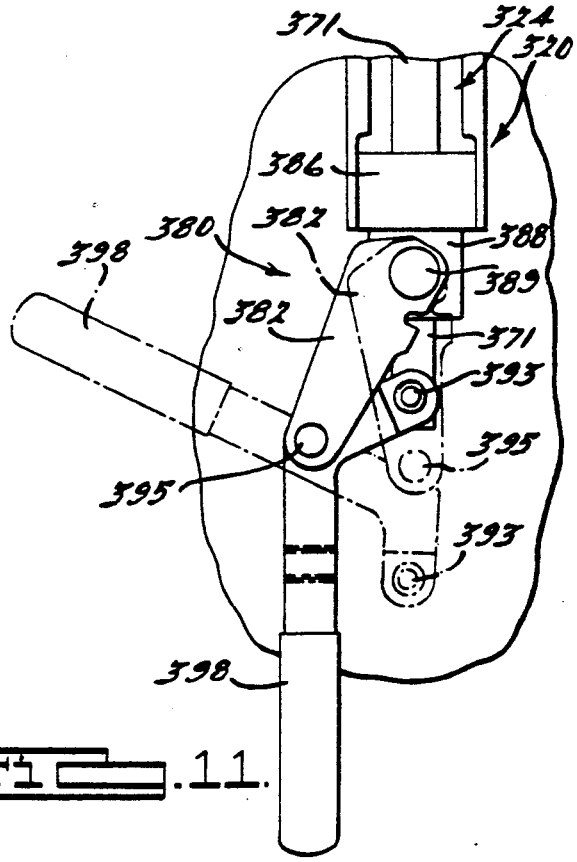
FIG. 11 is an elevational view similar to that of FIG. 10, but illustrating the anchoring handle laterally pivoted to one side and also illustrating the longitudinal movement of the anchoring handle.

FIGS. 10 and 11 illustrate an alternate, but perhaps preferred, handle or lever mechanism portion 380 of another embodiment of the present invention in an exemplary anchoring and tensioning apparatus 320. Other than the handle or lever mechanism 380, the anchoring and tensioning apparatus 320 is generally similar to the anchoring and tensioning apparatus 220 illustrated in FIGS. 8 and 9. Therefore, similar or corresponding elements of the apparatus 320 are indicated by reference numerals similar to those of the apparatus 220, but having three-hundred prefixes.

In the handle or lever mechanism 380 of FIGS. 10 and 11, the handle member 398 is pivotally interconnected with the adjustment member 371 by way of a pivot pin 393. The handle member 398 is also pivotally interconnected with a pivot link 382 by way of a pivot pin 395, and the pivot link 382 is pivotally interconnected with a block member 383 that abuttingly engages in abutment member 386, which is longitudinally restrained and fixed relative to the base member 324.

The adjustment member 371 extends through openings in the block member 388 and the abutment member 386, with the abutment member 388 being rotationally restrained with respect to the adjustment member 371. The adjustment member 371, and thereby the block member 388, are rotationally movable relative to the abutment member 386, along with the link member 382 and the handle member 398. By such an arrangement, the handle member 398 is laterally pivotal relative to the base member 324 and the remainder of the billboard structure, thus allowing the handle member 398 to be laterally pivoted from side to side in any longitudinally pivoted position. This arrangement is highly advantageous in that it allows for longitudinal actuation of the anchoring and tensioning apparatus 320 with the handle 398 laterally pivoted to any position that is convenient or necessary in order to avoid interference with other billboard structure components. In addition, the laterally pivotal capability of the handle member 398 of the apparatus 320 allows the handle member 398 to be laterally pivoted to a stored position when tensioning or relaxation of the sheet material display is not being performed. Although such feature is not explicity shown in FIGS. 10 and 11, it should be readily understood that the adjustment member 371 can also include the feature by which the longitudinal range of pivotal movement of the handle member 398 can be adjusted in a manner similar to that described above in connection with the apparatus 220 shown in FIGS. 8 and 9. It should also be noted that while the mechanism 380, like the mechanism 280 described above, is commercially available and was used to construct an actual prototype, other such pivotal mechanisms can also alternately be used.

Figure 12:
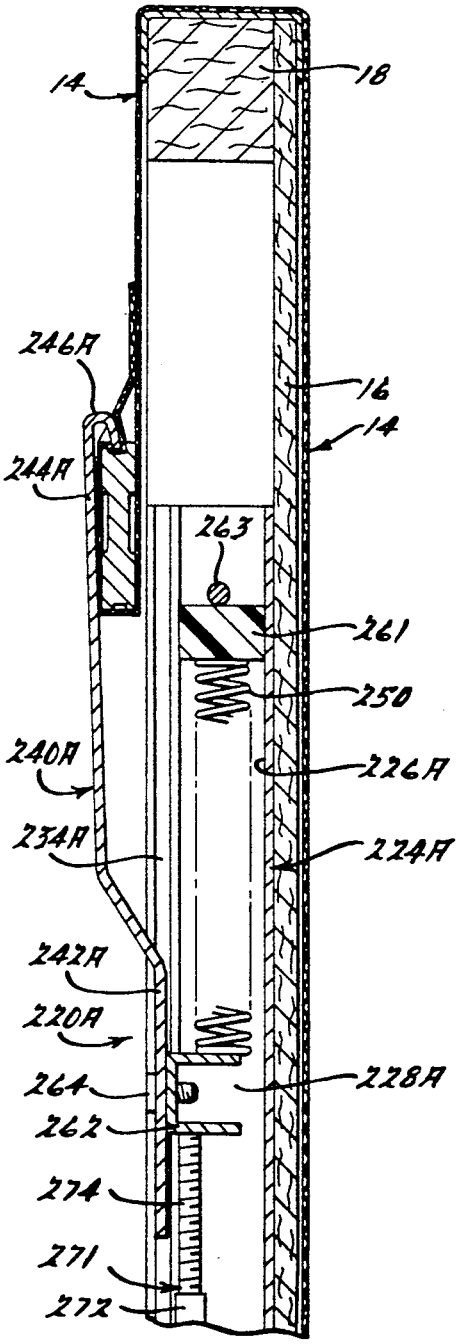
FIG. 12 illustrates an exemplary optional variation, usable in any of the embodiments of the invention, wherein the clip portion of the apparatus is longitudinally enlarged in order to allow for more convenient positioning of the apparatus in applications where interference with other billboard components is to be avoided.

FIG. 12 illustrates a variation or option on the present invention that is applicable to any of the embodiments of the invention. Such an optional variation is illustrated in FIG. 12 in the context of an anchoring and tensioning apparatus 220A, which is substantially identical with the previously-described apparatus 220 shown in FIGS. 8 and 9, but with the exceptions discussed below.

In the apparatus 220A, the clip member 240A is substantially similar to the clip member 240 described above except that the attachment portion 244A is longitudinally elongated in order to accommodate special circumstances in a given application for mounting the anchoring and tensioning apparatus, or for accommodating the need to provide greater access for installation personnel. The base member 224A is also correspondingly longitudinally elongated in order to accommodate the longitudinally elongated clip member 240A. By such an arrangement, a greater "reach" of the anchoring and tensioning apparatus 220A is provided, which is especially advantageous where access platforms are located a greater distance away from billboard edges than is customarily found.

Figure 13:
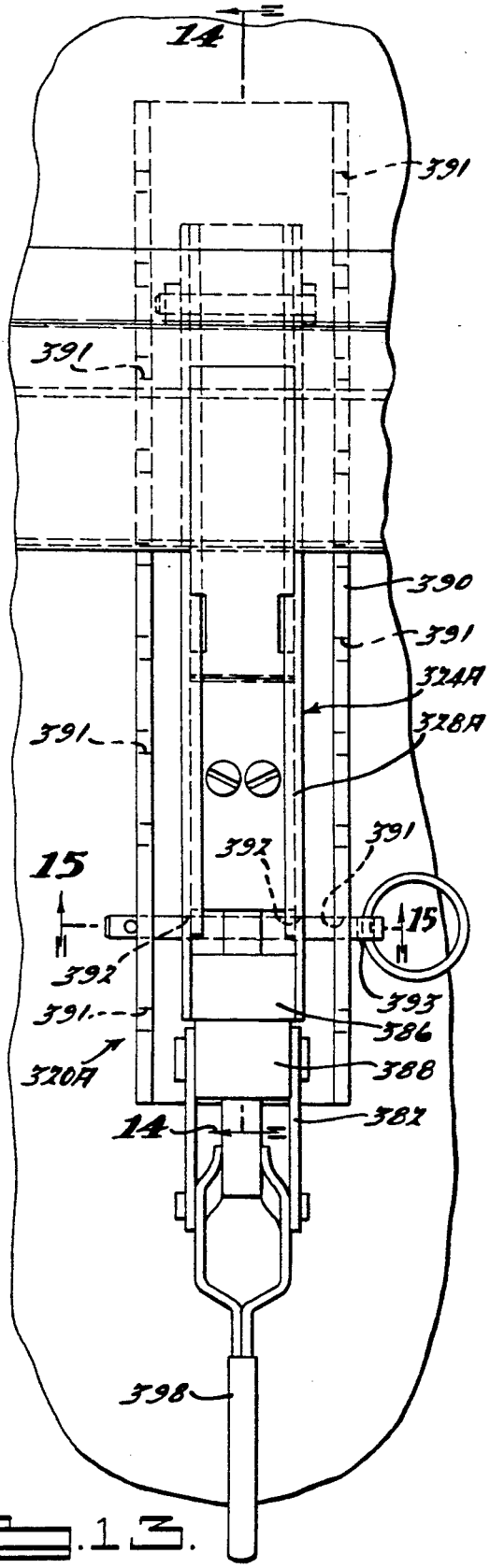
FIG. 13 is an elevational view of still another optional variation, which is usable in conjunction with any of the embodiments of the invention, and which includes a variable mounting device for selectively adjusting to longitudinal position of the anchoring and tensioning portion of the apparatus relative to the billboard.
Figure 14:
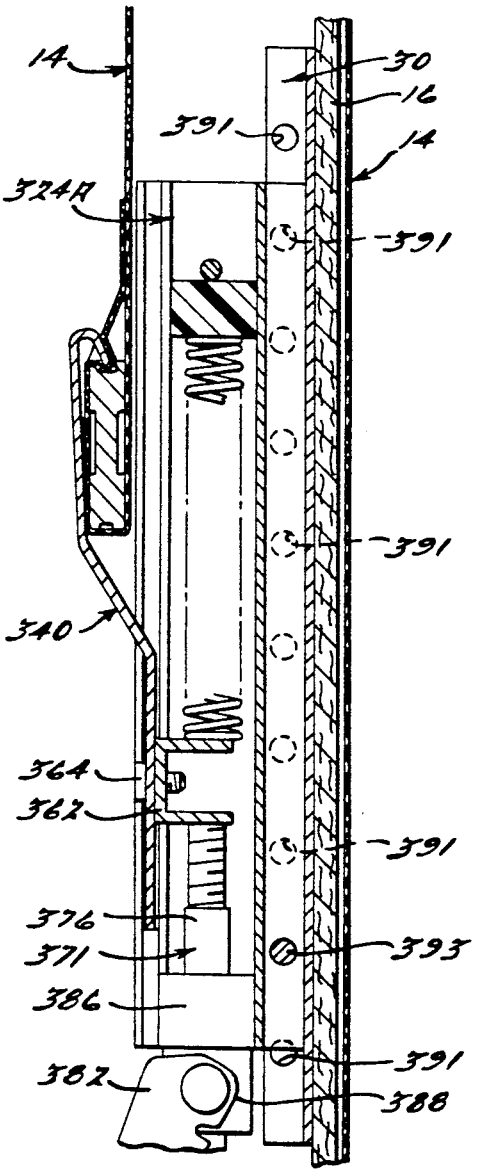
FIG. 14 is a cross-sectional view taken generally along line 14—14 of FIG. 13.
Figure 15:
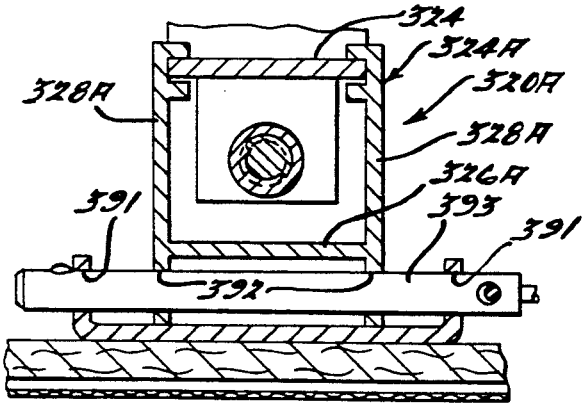
FIG. 15 is a cross-sectional view taken generally along line 15—15 of FIG. 13.

FIGS. 13 through 15 illustrate still another optional variation, which is also equally applicable to any of the embodiments of the present invention. This optional variation is shown, merely for purposes of illustration, in the context of a modified version of the anchoring and tensioning apparatus 320 of FIGS. 10 and 11 and is substantially identical to the apparatus 320, with the exceptions discussed below.

In the modified optional apparatus 320A, the leg portions 328A of the base member 324A are provided with openings 392 extending laterally therethrough. The apparatus 320A also includes a base mounting member 390, which is preferably a generally U-shaped channel member similar to that of the base member 324A, but having its legs laterally spaced farther apart.

The base mounting member 390 is fixedly secured to, or interconnected with, the billboard structure and includes a number of serially spaced-apart openings 391 extending laterally therethrough. This arrangement allows the insertion of a hitch pin 393 through any of the openings 391 in the base mounting member 390 and through the leg portions 328A of the base member 324A, thereby allowing for a wide range of preselected adjustability of the operational longitudinal position of the anchoring and tensioning apparatus 320A relative to the billboard. Like the embodiment illustrated in FIG. 12, the apparatus 320A provides for greater flexibility in terms of positioning of the apparatus relative to the billboard structure, as well as greater flexibility in terms of personnel access for installation and tensioning of the sheet material display.

Figure 16:
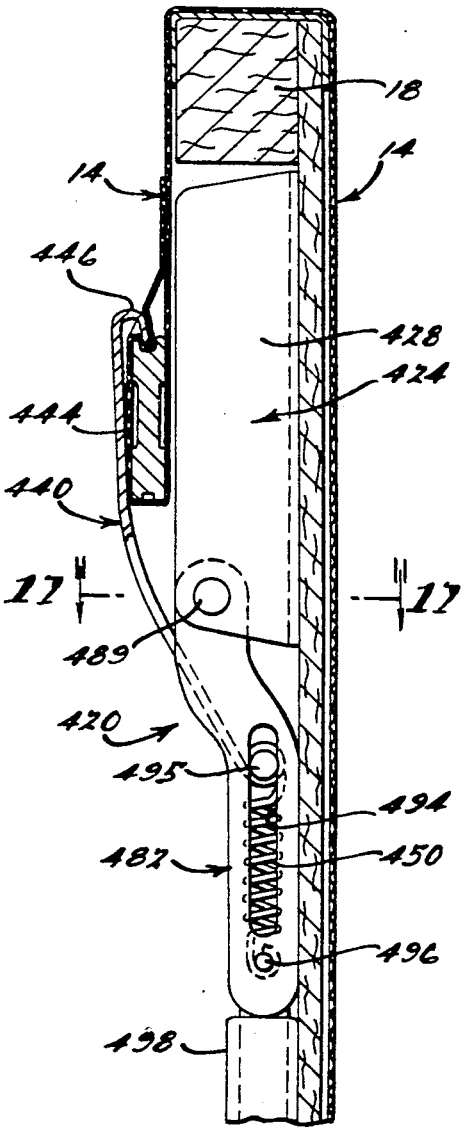
FIG. 16 is a longitudinal cross-sectional view of still another embodiment of the present invention.
Figure 17:
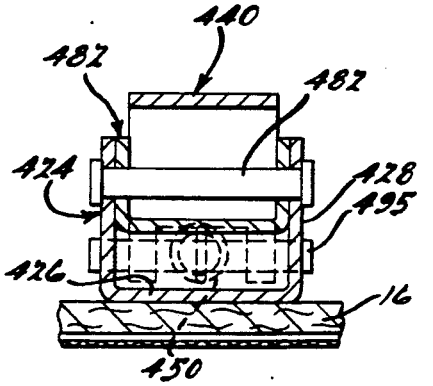
FIG. 17 is a cross-sectional view taken generally along line 17—17 of FIG. 16.

Finally, FIGS. 16 and 17 illustrate still another embodiment of the present invention, in which the anchoring and tensioning apparatus 420 is somewhat similar in many respects, at least in terms of the function of its elements, to the anchoring and tensioning apparatuses described above. Thus, similar or corresponding elements of the anchoring and tensioning apparatus 420 are indicated by reference numerals similar to those of the other embodiments of the present invention, but having four-hundred prefixes.

In FIGS. 16 and 17, the anchoring and tensioning apparatus 420 includes a pivot link 482 secured to the handle member 498 for pivotal longitudinal movement relative to the base member 424 by way of a pivot pin 489. The pivot link 482 includes a longitudinally elongated slot 494 extending laterally therethrough. Within the slot 494, a pin 495 is longitudinally slidably received. The clip member 440 is rotationally or pivotally interconnected with the pin 495, which also is secured to one end of the spring 450, with the opposite end of the spring 450 being longitudinally restrained relative to the pivot link 482 by way of a restraining pin 496.

By such an arrangement, longitudinally pivotal movement of the handle member 498 causes longitudinally pivot movement of the pivot link 482 and the corresponding resilient deflection of the spring member 450, thereby allowing for selective tensioning and relaxation of the sheet material display 14 upon actuation of the anchoring and tensioning apparatus 420. It should be noted that in the preferred arrangement, the handle member 498 is longitudinally pivoted to a tensioning position when it is pivotally moved in an over-center relationship relative to the pivot pin 489 to the position shown in FIG. 16. By way of the longitudinally slidable relationship of the pin 495 within the slot 494 in the pivot link 482, the spring member 450 is best allowed to resiliently bias the clip member 440 and thus the sheet material display 14 in a tensioning direction, while still resiliently accommodating expansion and contraction of the sheet material display 14. As one skilled in the art will readily appreciate, the pivot arrangement of the apparatus 420 illustrated in FIGS. 16 and 17 can optionally be incorporated with the laterally pivotal arrangement of the handle member 398 shown in FIGS. 10 and 11 and in FIGS. 13 through 15.

The foregoing discussion discloses and describes exemplary embodiments of the present invention. One skilled in the art will readily recognize from such discussion, and from the accompanying drawings and claims, that various changes, modification and variations may be made therein without departing from the spirit and scope of the invention as defined in the following claims.

We claim:

1. An apparatus for anchoring and selectively tensioning and relaxing a sheet material display on a billboard, said apparatus comprising:

an elongated base member having a generally U-shaped lateral cross-section, said base member including a base plate portion and a pair of laterally spaced-apart leg portions protruding from said base plate portion, each of said leg portions having a slot formed therein, said slots facing generally toward one another;

means for fixedly interconnecting said elongated base member with the billboard;

clip member having a clip plate portion received within said slots for selective slidable longitudinal movement along said base member;

and attachment portion for releasably engaging a portion of the sheet material display;

clip biasing means for selectively resiliently biasing said clip member relative to said base member in a first longitudinal direction in order to selectively tension the sheet material on the billboard;

release means for selectively moving said clip member relative to said base member in an opposite longitudinal direction in order to relax the sheet material, said release means including a handle member movable between a first longitudinal position wherein said clip member is forcibly urged by said handle member against the resilient biasing force of said clip biasing means to relax the sheet material and a second opposite longitudinal position wherein said clip biasing means is allowed to resiliently bias said clip member in said first longitudinal direction in order to selectively tension the sheet material;

said handle member being interconnected with said apparatus and pivotally movable generally longitudinally between said first and second longitudinal positions; and said handle member also being pivotally movable generally laterally in either said first of said second longitudinal pivoted position.

2. An apparatus according to claim 1, wherein said handle member is also pivotally movable generally laterally in substantially any longitudinally pivoted position.

3. An apparatus accordidng to claim 2 wherein said handle member is interconnected with said clip member, said apparatus further including longitudinal adjustment means for selectively adjusting the range of longitudinal movement of said handle member.

4. An apparatus for anchoring and selectively tensioning and relaxing a sheet material display on a billboard, said apparatus comprising:

an elongated base member having a generally U-shaped lateral cross-section, said base member including a base plate portion and a pair of laterally spaced-apart leg portions protruding from said base plate portion, each of said leg portions having a slot formed therein, said slots facing generally toward one another;

means for fixedly interconnection said elongated base member with the billboard;

a clip member having a clip plate portion received within said slots for selective slidable longitudinal movement along said base member;

an attachment portion for releasably engaging a portion of the sheet material display;

clip biasing means for selectively resiliently biasing said clip member relative to said base member in a first longitudinal direction in order to selectively tension the sheet material on the billboard;

release means for selectively moving said clip member relative to said base member in an opposite longitudinal direction in order to relax the sheet material, said release means including a handle member movable between a first longitudinal position wherein said clip member is forcibly urged by said handle member against the resilient biasing force of said clip biasing means to relax the sheet material and a second opposite longitudinal position wherein said clip biasing means is allowed to resiliently bias said clip member in said first longitudinal direction in order to selectively tension the sheet material;

said handle member being interconnected with said clip member; and longitudinal adjustment means for selectively adjusting the range of longitudinal movement of said handle member.

5. An apparatus for anchoring and selectively tensioning and relaxing a sheet material display on a billboard structure having at least one edge, said apparatus comprising:

a base member having a length substantially greater than its width and having a longitudinal axis extending along its length;

means for connecting said base member to said billboard, said base member being positioned such that its length and longitudinal axis are substantially perpendicular to said elongated edge;

slide means slidably affixed to said base member, said slide means being slidable only along and in the direction of said longitudinal axis;

connection means on said slide means for releasably attaching said slide means to said sheet material;

bias means for selectively biasing said slide means relative to said base member and in the direction of said longitudinal axis; and handle means for moving said slide means in a direction alond said longitudinal axis to bias said bias means and selectively tension said sheet material on the surface structure;

said handle means being pivotally interconnected with said apparatus around a second axis generally transverse to said longitudinal axis of said base member and movable generally longitudinally between first and second longitudinal positions, said bias means tensioning said sheet material when said handle is in said first longitudinal position and said bias means being relieved of tensioning said sheet material when said handle is in said second longitudinal position;

said handle means having a manually graspable portion which extends outwardly substantially perpendicular to said longitudinal axis when said handle means is in said second longitudinal position; and said handle means being pivotally movable generally laterally.

6. An apparatus for anchoring and selectively tensioning and relaxing a sheet material display on a billboard structure having at least one edge, said apparatus comprising:

a base member having a length substantially greater than its width and having a longitudinal axis extending along its length;

means for connecting said base member to said billborad, said base member being positioned such that its length and longitudinal axis are substantially perpendicular to said elongated edge;

slide means slidably affixed to said base member, said slide means being slidable only along and in the direction of said longitudinal axis;

connection means on said slide means for releasably attaching said slide means to said sheet material;

bias means for selectively biasing said slide means relative to said base member and in the direction of said longitudinal axis;

handle means for moving said slide means in a direction along said longitudinal axis to bias said bias means and selectively tension said sheet material on the surface structure;

said handle means being pivotally interconnected with said apparatus around a second axis generally transverse to said longitudinal axis of said base member and movable generally longitudinally between first and second longitudinal positions, said bias means tensioning said sheet material when said handle is in said first longitudinal position and said bias means being relieved of tensioning said sheet material when said handle is in said second longitudinal position;

said handle means having a manually graspable portion which extends outwardly substantially perpendicular to said longitudinal axis when said handle means is in said second longitudinal position; and means for adjusting the range of longitudinal movement of said handle means.

7. The apparatus as set forth in claim 5 further comprising channel means in said base member for receipt and sliding movement of said slide means.

8. The apparatus as set forth in claim 7 wherein said base member has a generally U-shaped cross-section, a base plate portion and a pair of laterally spaced-apart leg portions, each of said leg portions having a channel therein, said channels facing generally toward one another.

9. The apparatus as set forth in claim 5 wherein said connection means includes a clip member which engages a portion of said sheet material.

10. The apparatus as set forth in claim 9 further comprising anchor means along at least one edge of said sheet material and said clip member is releasably attached to said anchor means.

11. The apparatus as set forth in claim 5 wherein said bias means comprised a spring member on said base member.

12. The apparatus as set forth in claim 11 wherein said spring member comprises a coil spring.

13. An apparatus for anchoring and selectively tensioning and relaxing a sheet material display on a surface structure having at least one edge, said apparatus comprising:

a base member having a length substantially greater than its width and having a longitudinal axis extending along its length;

means for connecting said base member to said surface structure, said base member being positioned such that its length and longitudinal axis are substantially perpendicular to said edge;

slide means slidably affixed to said base member and slidable therein, said slide means being slidable only along said longitudinal axis of said base member;

connection means on said slide means for releasably attaching said slide means to said sheet material;

bias means for selectively biasing said slide means relative to said base member and in the direction of said longitudinal axis;

activating means for moving said slide means in a direction along said longitudinal axis to bias said bias means and selectively tension said sheet material on the surface structure;

said activating means being pivotally interconnected with said apparatus around a second axis generally transverse to said longitudinal axis of said base member and movable generally longitudinally between first and second longitudinal positions, said bias means tensioning said sheet material when said activating means is in said first longitudinal position and said bias means being relieved of tensioning said sheet material when said activating means is in said second longitudinal position;

said activating means having an over-center means for securely holding said activating means in a position biasing said bias means;

said activating means having a manually graspable portion which extends outwardly substantially perpendicular to said longitudinal axis when said activating means is in said second longitudinal position; and said activating means being pivotally movable generally laterally.

14. An apparatus for anchoring and selectively tensioning and relaxing a sheet material display on a surface structure having at least one edge, said apparatus comprising:

a base member having a length substantially greater than its width and having a longitudinal axis extending along its length;

means for connecting said base member to said surface structure, said base member being positioned such that its length and longitudinal axis are substantially perpendicular to said edge;

slide means slidably affixed to said base member and slidable therein, said slide means being slidable only along said longitudinal axis of said base member;

connection means on said slide means for releasably attaching said slide means to said sheet material;

bias means for selectively biasing said slide means relative to said base member and in the direction of said longitudinal axis;

activating means for moving said slide means in a direction along said longitudinal axis to bias said bias means and selectively tension said sheet material on the surface structure;

said activating means being pivotally interconnected with said apparatus around a second axis generally transverse to said longitudinal axis of said base member and movable generally longitudinally between first and second longitudinal positions, said bias means tensioning said sheet material when said activating means is in said first longitudinal position and said bias means being relieved of tensioning said sheet material when said activating means is in said second longitudinal position;

said activating means having an over-center means for securely holding said activating means in a position biasing said bias means;

said activating means having a manually graspable portion which extends outwardly substantially perpendicular to said longitudinal axis when said activating means is in said second longitudinal position; and means for adjusting the range of longitudinal movement of said activating means.

15. The apparatus as set forth in claim 13 further comprising channel means in said base member for receipt and sliding movement of said slide means.

16. The apparatus as set forth in claim 13 wherein said connection means include a clip member which engages a portion of said sheet material.

17. The apparatus as set forth in claim 13 wherein said bias means comprises a spring member on said base member.

18. An apparatus for anchoring and selectively tensioning and relaxing a sheet material display on a billboard structure, said apparatus comprising:

a base member;

means for connecting said base member to said billboard;

slide means slidably affixed to said base member;

connection means on said slide means for releasably attaching said slide means to said sheet material;

bias means for selectively biasing said slide means relative to said base member;

handle means for moving said slide means in a direction to bias said bias means and selectively tension said sheet material on the billboard structure;

said handle means being pivotally interconnected with said apparatus and movable generally longitudinally between first and second longitudinal positions, said bias means tensioning said sheet material when said handle is in said first longitudinal position and said bias means being relieved of tensioning said sheet material when said handle is in said second longitudinal position; and said handle means being pivotally movable generally laterally.

19. An apparatus for anchoring and selectively tensioning and relaxing a sheet material display on a billboard structure, said apparatus comprising:

a base member;

means for connecting said base member to said billboard;

slide means slidably affixed to said base member;

connection means on said slide means for releasably attaching said slide means to said sheet material;

bias means for selectively biasing said slide means relative to said base member;

handle means for moving said slide means in direction to bias said bias means and selectively tension said sheet material on the billboard structure;

said handle means being pivotally interconnected with said apparatus and movable generally longitudinally between first and second longitudinal positions, said bias means tensioning said sheet material when said handle is in said first longitudinal position and said bias means being relieved of tensioning said sheet material when said handle is in said second longitudinal position; and means for adjusting the range of longitudinal movement of said handle means.

20. An apparatus for anchoring and selectively tensioning and relaxing a sheet material display on a surface structure, said apparatus comprising:

a base member;

means for connecting said base member to said surface structure;

slide means slidably affixed to said base member;

connection means on said slide means for releasably attaching said slide means to said sheet material;

bias means for selectively biasing said slide means relative to said base member;

handle means for moving said slide means in a direction to bias said bias means and selectively tension said sheet material on the surface structure;

said handle means being pivotally interconnected with said apparatus and movable generally longitudinally between first and second longitudinal positions, said bias means tensioning said sheet material when said handle is in said first longitudinal position and said bias means being relieved of tensioning said sheet material when said handle is in said second longitudinal position;

said handle means having an over-center means for securely holding said handle in a position biasing said bias means; and said handle means being pivotally movable generally laterally.

21. An apparatus for anchoring and selectively tensioning and relaxing a sheet material display on a surface structure, said apparatus comprising:

a base member;

means for connecting said base member to said surface structure;

slide means slidably affixed to said base member;

connection means on said slide means for releasably attaching said slide means to said sheet material;

bias means for selectively biasing said slide means relative to said base member;

handle means for moving said slide means in a direction to bias said bias means and selectively tension said sheet material on the surface structure;

said handle means being pivotally interconnected with said apparatus and movable generally longitudinally between first and second longitudinal positions, said bias means tensioning said sheet material when said handle is in said first longitudinal position and said bias means being relieved of tensioning said sheet material when said handle is in said second longitudinal position;

said handle means having an over-center means for securely holding said handle in a position biasing said bias means; and means for adjusting the range of longitudinal movement of said handle means.

* * * * *